US009410772B2

(12) United States Patent
Berroth et al.

(10) Patent No.: US 9,410,772 B2
(45) Date of Patent: Aug. 9, 2016

(54) BALLISTIC PROTECTION CONFIGURATION

(75) Inventors: Karl Berroth, Frankenblick (DE); Thomas Vorsatz, Suhl (DE)

(73) Assignee: FCT Igenieurkermik GmbH, Raunstein (DE)

( * ) Notice: Subject to any disclaimer, the term of this patent is extended or adjusted under 35 U.S.C. 154(b) by 202 days.

(21) Appl. No.: 14/123,417

(22) PCT Filed: May 29, 2012

(86) PCT No.: PCT/DE2012/000556

§ 371 (c)(1),
(2), (4) Date: Dec. 2, 2013

(87) PCT Pub. No.: WO2012/163329

PCT Pub. Date: Dec. 6, 2012

(65) Prior Publication Data

US 2014/0116235 A1 May 1, 2014

(30) Foreign Application Priority Data

Jun. 1, 2011 (DE) ..... 20 2011 101 638 U

(51) Int. Cl.
*F41H 5/02* (2006.01)
*F41H 5/04* (2006.01)

(52) U.S. Cl.
CPC ..... *F41H 5/0414* (2013.01); *F41H 5/04* (2013.01); *F41H 5/0428* (2013.01); *F41H 5/0492* (2013.01)

(58) Field of Classification Search
USPC ..... 89/36.02, 36.05, 36.01, 36.07; 2/2.5, 2/411
See application file for complete search history.

(56) References Cited

U.S. PATENT DOCUMENTS

| | | | | |
|---|---|---|---|---|
| 3,577,836 | A * | 5/1971 | Tamura | A41D 31/0061 2/2.5 |
| 8,215,223 | B2 | 7/2012 | Lucuta et al. | |
| 2001/0015157 | A1 * | 8/2001 | Neal | B32B 3/06 109/49.5 |
| 2007/0172677 | A1 | 7/2007 | Biermann et al. | |

FOREIGN PATENT DOCUMENTS

| | | | |
|---|---|---|---|
| DE | 4005904 | A1 | 8/1991 |
| DE | 60221849 | T2 | 5/2008 |
| DE | 102007019392 | A1 | 10/2008 |
| WO | 9208094 | A1 | 5/1992 |

* cited by examiner

*Primary Examiner* — J. Woodrow Eldred

(74) *Attorney, Agent, or Firm* — Laurence A. Greenberg; Werner H. Stemer; Ralp E. Locher

(57) ABSTRACT

A ballistic protection configuration includes a plurality of hard-armoring shaped elements which are formed as one piece and have at least two mutually offset planes. At least two of the shaped elements are fixed in a positional relationship with respect to one another in a shaped element composite in such a way that a first plane of a first shaped element overlaps in sections a second plane of a second shaped element. With the at least two overlapping planes of two shaped elements, two whole surfaces, which lie one above the other and offset with respect to one another, are formed in the shaped element composite and make it possible for a shaped element composite to be provided which is completely free of linear penetrations.

13 Claims, 4 Drawing Sheets

BALLISTIC PROTECTION CONFIGURATION

BACKGROUND OF THE INVENTION

Field of the Invention

The invention relates to a ballistic protection means for protection against firearms, the effects of splintering and of stabbing weapons.

Various types of ballistic protection devices are known from the prior art.

One solution consists of a hard-armouring protection means in which fired projectiles or bullets are rendered harmless upon contact with hard materials, for example, by breakage, deformation and deflection of the projectile or by transmission of the kinetic energy. In particular, at least one bullet-breaking layer is used, wherein the bullet-breaking layer is usually formed by large-format individual elements, more rarely by a plurality of elements disposed next to one another.

It is also known from the prior art to select the arrangement of the individual bullet-breaking elements or their geometric design in such a way that as far as possible no gaps, which pass right through to a base surface to be protected, are produced within the ballistic protection device.

Ballistic protection devices of this type are used in particular within the framework of protective vests or of armour-plating for objects.

A generic device is disclosed, for example, as a composite armour-plating element, in DE 10 2007 019 392 B4.

In that case at least one row of rod-like elements, which are disposed axially one behind the other and surrounded by a cast compound, is used.

The rod-like elements are formed in such a way that they engage one in another in a positive-locking manner such that when impacted by a projectile, the elements yield without a gap and therefore a ballistic hole being formed.

However, a disadvantage with the disclosed solution is that by reason of the positive-locking arrangement of the elements, the composite armour-plating has little or no elasticity and can therefore be adapted only to a limited extent to uneven or flexible base surfaces.

In particular, use within a protective vest is therefore possible only with limitations.

A generic ballistic protection means is disclosed by document DE 602 21 849 T2.

The armour-plating system described therein is predominantly designed for use on vehicles or buildings and has, inter alia, a plurality of ceramic elements which are formed abutting against one another or overlapping.

The overlapping of the elements can be achieved, inter alia, in that they are each provided on two sides with L-shaped edges which form the overlap.

The region between the overlapping edges is filled with an adhesive and thus connects the elements together in a firmly bonded manner.

The disadvantages of the solution disclosed herein are on the one hand the fact that overlapping regions are formed on only two sides of the elements, whereby, under some circumstances, gap formation takes place on the remaining sides of the elements.

On the other hand, the thickness of the respective overlapping elements in the overlapping regions corresponds only to a part of the total thickness of an individual element, whereby an individual element in the overlapping regions is more susceptible to damage by bullets or projectiles.

Furthermore, it is also possible in this case where the elements are formed in an L shape and adhered to one another, only for relatively slight flexibility in the armour-plating system to be provided.

BRIEF SUMMARY OF THE INVENTION

It is the object of the invention to create a ballistic protection means with improved effectiveness with respect to penetration by projectiles and stabbing weapons while avoiding the disadvantages of the prior art, this ballistic protection means having a high level of flexibility, a low surface weight in relation to the protective effect and improved ability to resist multiple shots.

The object is achieved by the features stated in as claimed. Preferred developments are found in the disclosure.

A ballistic protection means in accordance with the invention has a plurality of, in particular, hard-armouring shaped elements, also designated hereinunder only as shaped elements. Hard armouring is generally understood to mean that a bullet, also termed a projectile herein under, impacts a hard material and that the kinetic energy of the bullet is dissipated and distributed upon impact with the hard material, wherein the projectile and/or the hard material can be deformed or destroyed.

A particular advantage of the shaped elements is that they have at least two mutually offset planes, wherein the planes are materially connected to one another by the single-piece design of the shaped elements.

An offset arrangement of the planes of a shaped element is to be understood in this context to mean that the planes are offset with respect to one another both horizontally and also vertically.

At least two of the shaped elements provided in accordance with the invention are fixed in a positional relationship with respect to one other in a shaped element composite in such a way that a first plane of a first shaped element partially overlaps a second plane of a second shaped element. In a shaped element composite in accordance with the invention, a first shaped element can partially overlap up to three further shaped elements in the second plane thereof. The same applies to any possible further planes.

By the arrangement in accordance with the invention of the at least two overlapping planes of two shaped elements, two superimposed and mutually offset whole surfaces or collective surfaces in total are in practice formed in the shaped element composite, these whole surfaces advantageously permitting a shaped element composite in accordance with the invention to be provided completely free of any linear penetrations.

Penetrations are to be understood to mean openings within a ballistic protection means, through which a bullet or, for example, a needle can pass unhindered through the ballistic protection means to an object to be protected.

Objects to be protected are considered in the case of the present invention to be living objects such as people or animals, or vehicles or buildings.

Furthermore, it is also possible to consider all feasible, in particular technical, installations as objects to be protected in terms of the ballistic protection means in accordance with the invention against impacting bullets. The ballistic protection means in accordance with the invention can either lie on the object to be protected or even, for example, be used as a freely suspended mat.

By reason of the small segmentation owing to the plurality of shaped elements, the present shaped element composite in accordance with the invention has the considerable advantage over known ballistic protection means that it is clearly less susceptible to total destruction than hard-armouring devices which are segmented as large surfaces. When a bullet impacts a shaped element only a very small part of the shaped element composite is damaged or destroyed, this preferably corresponding only to the calibre of the projectile depending on the selected segmentation.

The remaining shaped elements remain fully functional, wherein by reason of a preferred small segmentation of the shaped elements and of the plane offsetting, the size of the penetration resulting from the failure of one shaped element is very small. In this way, the so-called multi-hit capability of the ballistic protection means in accordance with the invention is also substantially improved over conventional devices.

Furthermore, by small-segmentation the flexibility and therefore the ability to adapt easily to surfaces to be protected is considerably improved over conventional hard-armouring systems.

Furthermore, by the material connection of the at least two planes in each shaped element, the positional relationship between the at least two formed and mutually offset whole surfaces is reliably fixed so that the whole surfaces cannot slip with respect to one another when subjected to a shot or stabbing action. Transverse and/or shear stresses between the whole surfaces can therefore be absorbed and dissipated more satisfactorily than in the known ballistic devices. The absence of linear penetrations is thereby retained as a particular advantage. A further advantage is that owing to the material connection of the at least two planes no additional measures are required in each shaped element to ensure offsetting during production of a shaped element composite.

In a preferred embodiment, the shaped elements are formed in such a way that by designing the connection region between the two planes of a shaped element with dimensioning suitable for the specific material, if a crack is formed in the first plane when subjected to a shot, the crack is prevented from continuing from the first plane into the second plane. In this preferred embodiment, the second plane is therefore preserved and improves the multi-hit capability.

In accordance with the invention, the formed shaped element composite has a side facing an impacting bullet, herein under also designated the impact side, and a side facing the object to be protected, herein under also designated the protection side.

Depending on use, the planes of the shaped elements can have different geometric shapes, such as for example rectangular, triangular or trapezoidal shapes.

A preferred development of this ballistic protection means makes provision for the shaped elements on the side facing the object to be protected to be connected to a high-tensile and shear-resistant support layer, for example of aramid fibres. The connection between the shaped elements and the support layer is advantageously produced by adhesion.

By the connection of the shaped elements to the high-tensile and shear-resistant support layer a shaped element composite is created which offers a particularly high level of resistance to the ballistic protection means against impacting bullets.

The high-tensile properties of the support layer mean that reinforcement of the shaped element composite is achieved. The force action from the bullet transverse to the planar plane of the ballistic protection means (transverse pulse) tries to curve in the ballistic protection means concavely towards the protection side. The shaped elements thereby come to lie against one another at the end faces thereof and form a pressure zone facing the force impact side, while at the same time the support layer is subjected to tension (longitudinal pulse) and forms the tension zone facing away from the force impact side. The shaped element composite therefore acts as a large-surface shield owing to the single-side rigidity, while reversed curvature remains possible and a high level of flexibility is therefore present.

If the ballistic protection means in accordance with the invention in a state of convex curvature, as produced at many points in particular by the body shape of the wearer, is subjected to a shot, then as well as or instead of the described bending-resistance by the force transmission at the end faces of the shaped elements a pressure curve can be formed which transmits at least part of the energy of the bullet lengthwise into the ballistic protection means and therefore around the wearer.

A particular advantage over the prior art is that not only the surface and mass of a hard-armouring element or, in the case of scales or similar solutions, the surface and mass of the hard-armouring elements, which are in a positive-locking arrangement with one another, are effective. It is rather the case that the force flow in the plane of the ballistic protection means in accordance with the invention causes shaped elements which are not disposed in the region of the point of impact also to be included. It is particularly advantageous that the included shaped elements are not affected directly by the destructive effect caused by the high-energy pulse of the projectile and are reliably decoupled from a continuation of cracking from the impact site.

By means of the solution proposed herein, a way has unexpectedly been found to utilise the already pressure-stable properties of hard-armouring elements with use as a pressure zone to achieve a bending-resistance in the shaped element layer in a further way to increase the protective effect. In the case of the preferred use of ceramic shaped elements the material-specific advantage of extremely high pressure-resistance is effectively exploited.

The shear-resistance of the support layer effectively prevents "migration" of the shaped elements or parts thereof through the support layer under the effect of a bullet, wherein at the same time the tensile strength of the support layer leads in a particularly advantageous manner to the shaped elements being pressed against one another in the longitudinal direction of the shaped element composite, in particular in the region of impact of the bullet.

Therefore the resulting pressure forces are conducted very advantageously into a further region, but ideally into the entirety of the shaped element composite in an annular manner and are thereby dissipated particularly effectively.

In a particularly advantageous embodiment of the ballistic protection means, an intermediate space formed between the respective shaped elements, which are in a positional relationship with one another, is provided with an elastic filler. In accordance with the invention, the filler can completely or only partially fill the intermediate space.

The filler is preferably formed in such a way that it acts in an energy-converting manner when it deforms as a result of the relative movement of the shaped elements when subjected to a shot.

By providing the intermediate space between the shaped elements, which are in a positional relationship with one another, with the elastic filler, a connection which is flexible—within defined limits—of the respective shaped elements to one another is created which in a particularly advantageous manner permits the shaped elements to perform a relative movement with respect to one another.

By means of this flexibility of the ballistic protection means which is achieved in accordance with the invention this ballistic protection means can be adapted extremely easily to uneven or flexible objects.

In particular when used within the framework of a protective vest, the flexibility greatly improves the wearing comfort of the ballistic protection means over conventional devices, since this ballistic protection means is not only able to be adapted to the respective body shape but also similarly does not excessively limit the movement of the person to be protected.

In another advantageous development of the invention, the shaped elements consist of a ceramic material.

The ceramic material used can, in accordance with the invention, be any known ceramic or ceramic composite materials which are suitable by reason of the material properties, and ceramic fibre composite materials. The use of, for example, ceramic laminates is particularly advantageous, which means that a plurality of ceramic layers are available and the destruction of a layer does not equate to the total failure of the whole shaped element.

The use of ceramic materials means that shaped elements can be provided which, while being of low intrinsic weight, are very hard and particularly resistant to heat and corrosion.

When the ballistic protection means is being used for a long period the corrosion resistance is of particular importance because in a particularly advantageous manner it is thereby avoided that in the worst case a decrease in the protective capability of the ballistic protection means over the duration of its use goes unnoticed.

In particular, the low weight of the shaped elements in comparison to conventional devices means that the comfort level when using the ballistic protection means in accordance with the invention is clearly improved further.

This low weight is particularly advantageous when using the ballistic protection means for the protection of land, amphibious or maritime vehicles against mines and explosive charges. Furthermore, it is a particular advantage that no magnetic attachments of explosive charges adhere to a ballistic protection means in accordance with the invention when ceramic materials are used.

In a further preferred development of the ballistic protection means, the shaped elements are disposed offset in a brickwork-like manner in the formed shaped element composite in the longitudinal direction thereof.

An offset arrangement of the shaped elements such as this leads in particular to each shaped element being in a positive-locking arrangement with at least two further shaped elements in the longitudinal direction of the shaped element composite even in its first plane.

In a particularly simple manner, a uniform distribution of the forces, arising by the impact of a bullet, onto a plurality of shaped elements at the same time is therefore favoured and the resistance is therefore improved.

Furthermore, the offset arrangement of the shaped elements and the uniform force distribution resulting there from within the shaped element composite means that in an advantageous manner the intensity of possible blunt traumas, such as contusions or breaks, especially when used inside a protective vest, is reduced.

A particular embodiment of the invention makes provision that the shaped elements each have three planes arranged in an offset manner with respect to one another.

In accordance with the invention, the offsetting of the planes is selected in such a way that the plane facing the impact side and the plane facing the protection side do not overlap.

The design of the shaped elements with three planes has, on the one hand, the particular advantage that no linear or point-shaped penetrations are present in the shaped element composite.

Therefore, the possibility of a direct passage of a bullet through the shaped element composite, as well as the danger of a pointed object such as a blade, spike or needle, being stabbed through it, is ruled out.

On the other hand, the design of the shaped elements with three planes means that the probability of a total failure of the ballistic protection means as a result of a complete destruction of a shaped element is further reduced since even if the plane of a shaped element is destroyed, an overlap with at least one plane of an adjacent shaped element is retained and therefore the shaped element composite remains intact at the affected site.

The ballistic protection means in accordance with the invention has, in a particularly advantageous development, a sacrificial layer placed in front of the shaped element composite on the impact side.

The development makes provision that the energy of a bullet impacting the impact side of the ballistic protection means is at least partially dissipated by the sacrificial layer. The dissipation of the energy preferably takes place through the deflection and/or deformation of the impacting bullet and by the at least partial destruction/shattering of the hard-armouring sacrificial elements of the sacrificial layer.

According to the development, a plurality of sacrificial elements are preferably used in the sacrificial layer and are formed for example as cubes consisting of a ceramic material such as silicon carbide. In particular, on the impact side the sacrificial elements preferably have additional deflector edges which deflect a bullet as it impacts the sacrificial elements and thereby prevent perpendicular impact of the bullet on the sacrificial elements. Therefore, in accordance with the invention, a part of the bullet's energy is dissipated by deflection even as it impacts. In addition, the impact of the projectile on a deflector edge causes an asymmetry in the force vectors, which leads to at least slight deviation of the projectile from its original trajectory and as a result thereof deflects the energy of the impact from the original impact point away onto a distinctly larger surface, which significantly enhances the protective effect of the system or relieves the point concentration thereof.

The deflector edges on the impact side of the ballistic protection means are preferably concave and advantageously lead to the sacrificial layer having no or only small surface portions oriented at a right angle to the impacting bullet.

In the case of high bullet energy levels, a considerable part of the dissipation of the energy of the bullet upon impact with the sacrificial layer is achieved by the at least partial destruction of the sacrificial elements, wherein the sacrificial elements are preferably, at least partially, shattered.

By the advantageously spatially dense packing of the sacrificial elements the splinters act at least partially on the respective adjacent sacrificial elements and thus effect a force penetration and therefore a force distribution in the planar plane of the sacrificial layer, which means that the portion of the kinetic energy thereby absorbed no longer leads to a force action oriented in the direction of the protection side and therefore acting upon the shaped element composite.

The destruction of the sacrificial elements also leads to a deformation of the impacting bullet.

In a particularly advantageous manner, the deformation is so great that the bullet, after possible passage through the sacrificial layer to the shaped element layer, is so severely deformed that it causes only slight or no damage to the shaped element layer.

By means of the plurality of sacrificial elements and the small segmentation of the sacrificial layer resulting therefrom, in particular the multi-hit capability of the ballistic protection means in accordance with the invention is considerably improved over known devices. Even if a sacrificial element is totally destroyed by an impacting bullet, the remaining sacrificial elements and especially the shaped element layer lying behind the sacrificial layer remain intact and fully functional. In order to optimise the multi-hit capability the sacrificial elements preferably have a surface facing the impact side of not more than 70 square millimeters. In addition to the presence of the second hard-armouring plane, by means of the shaped element composite the described small segmentation leads to a very low probability that a subsequent shot impacts at the site of the already destroyed sacrificial element. This takes account of the fact that multi-hit standards are based on a reference surface of one square inch. A particular advantage over the prior art is that a solution is disclosed in which the destruction of individual hard-armouring elements is included in the function in accordance with the invention without the multi-hit capability being significantly reduced.

In a preferred variation the sacrificial elements in the sacrificial layer are disposed in multiple layers or the whole sacrificial layer is formed with multiple layers. Particular geometries are also possible for the sacrificial elements in order to optimise the effect.

It has unexpectedly been found that a particularly effective dissipation of the bullet energy can be achieved when, in a preferred development of the invention, the sacrificial elements of the sacrificial layer are embedded into a splinter-slowing cast compound.

The embedding is effected around the sacrificial elements, for example, by vulcanisation of the cast compound.

The cast compound is formed to continue to be visco-elastic or visco-plastic and serves, in accordance with the invention, to at least partially absorb splinters released by the sacrificial elements or by the impacting bullet and to make it more difficult for them to exit the sacrificial layer both towards the impact side and also towards the shaped element layer and therefore to prevent these splinters acting as secondary projectiles.

The described cooperation of the sacrificial elements and the casting compound when subjected to a shot permits a large proportion of the energy dissipation through deformation so that lower surface dimensions are made possible.

The sacrificial layer preferably cooperates with the shaped element composite in a floating manner, whereby the flexibility of the ballistic protection means is additionally improved.

In an advantageous variation of the invention, the sacrificial layer is provided with a first splinter-catching layer placed in front of it.

The first splinter-catching layer is produced, for example, from a multi-layer aramid material and predominantly serves to catch splinters breaking away from the sacrificial elements and/or from the impacting bullet.

However, the first splinter-catching layer serves, in contrast to the cast compound of the sacrificial layer, exclusively to catch such secondary projectiles which exit the sacrificial layer in the direction of the impact side. It therefore serves to protect objects outside the overlapping region of the ballistic protection means, such as, for example, a person standing close by or non-covered parts of the body of the wearer of a protective vest in accordance with the invention.

The first splinter-catching layer is also connected in a floating manner to the sacrificial layer, whereby once again in a particularly advantageous manner the flexibility of the ballistic protection means in accordance with the invention is not negatively influenced.

In a similarly preferred development of the invention the shaped element composite is provided on the protection side with a second splinter-catching layer.

The second splinter-catching layer also consists, for example, of an aramid material and serves in accordance with the invention to catch fragments possibly released from the shaped element layer or bullet parts penetrating it under extreme loading.

Splinters of this type can be released, for example, from the shaped element layer, in particular when, under subjection to multiple hits, an impacting bullet or parts thereof hit the shaped element composite and damage it.

The connection between the shaped element layer and second splinter-catching layer is preferably effected in a floating manner, which means that the two layers can carry out a relative movement with respect to one another, which once again has a positive effect on the flexibility of the ballistic protection means.

Optionally an additional damping layer consisting, for example, of gel-filled or air-filled chambers can be disposed between the object to be protected and the second splinter-catching layer.

An additional damping layer such as this means that the intensity of blunt damage or traumas to the object to be protected by reason of the penetrating forces can be considerably reduced still further.

In order, in particular, to increase wearing comfort when using the ballistic protection means in a protective vest, the invention makes provision in a further preferred variation that a moisture-regulating and/or heat-regulating functional layer is arranged between the second splinter-catching layer and the person to be protected.

The functional layer has the property, for example by being air-permeable, of absorbing and discharging moisture produced under the ballistic protection means by a person wearing the ballistic protection means and of warming the person when the temperature is low or of counteracting a build-up of heat when the temperature is high.

A ballistic protection means in accordance with the invention can be used both in a protective vest and also in an armoured mat for protection of vehicles, buildings or people.

BRIEF DESCRIPTION OF THE SEVERAL VIEWS OF THE DRAWING

The invention will be described in more detail as an exemplified embodiments with reference to the drawings, in which.

DESCRIPTION OF THE INVENTION

Figure 1:
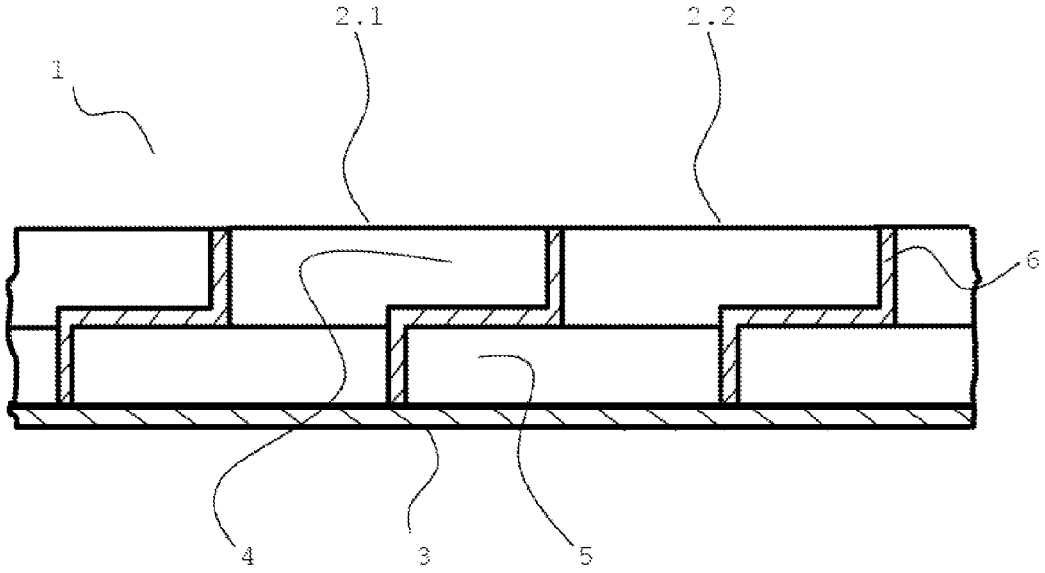
FIG. 1 shows a cross-sectional view of a shaped element composite.

FIG. 1 shows an exemplified embodiment of a shaped element composite 1 in accordance with the invention as a component of a ballistic protection means in a cross-sectional view from the side in the form of a schematic diagram.

The shaped element composite 1 is formed by a plurality of shaped elements 2 and a high-tensile and shear-resistant support layer 3.

The shaped elements 2 consist of a ceramic material and are connected to the support layer 3 by a maximum strength, non-releasable adhesive, whereby the positional relationship between the shaped elements 2 is also established in the further course thereof.

During use of the ballistic protection means in accordance with the invention, the support layer 3 assumes the reinforcing function for the shaped element composite 1.

Upon impact by a bullet (not shown) and the resulting curvature of the shaped element composite 1, a pressure zone is formed on the impact side thereof, in which pressure zone the shaped elements 2 are pressed against one another at least in sections.

Upon impact by a bullet, a tension zone forms in the support layer 3.

The combination in accordance with the invention of the pressure and tension zones leads in a particularly advantageous manner to the support layer composite 1 stiffening upon impact by a bullet and by the curvature effected thereby, and absorbing the forces introduced by the bullet and distributing them over a large surface and thereby dissipating them.

The intermediate space formed in each case between the shaped elements 2, which are arranged in a positional relationship with one another, within the shaped element composite 1 is provided with an elastic filler 6 in a preferred embodiment of the invention.

The elastic filler 6 is in the present case introduced into the shaped element composite 1 by vulcanisation.

In a particularly advantageous manner the elastic filler 6 causes firm bonding of the shaped elements 2 to one another, by which the capability of the shaped element composite 1 to resist impacting bullets is improved.

The shaped elements 2 themselves each have a first and a second plane 4 and 5 which are disposed offset with respect to one another both vertically and horizontally within the respective shaped element 2, wherein the offset arrangement of the two planes 4 and 5 is reliably secured by the material connection in the shaped element 2.

The shaped elements 2 are fixed in a positional relationship with respect to one another in the shaped element composite 1 in such a way that in each case the first plane 4 of a first shaped element 2.1 overlaps in sections the second plane 5 of a second shaped element 2.2.

The overlapping arrangement of the shaped elements 2 provides in a particularly advantageous manner a shaped element composite 1 which has no linear penetrations, through which an impacting bullet (not shown) could pass unresisted through the shaped element composite 1.

In order to further improve the capability of a ballistic protection means in accordance with the invention to resist impacting bullets, the ballistic protection means has additional layers in addition to the shaped element composite 1 in a further exemplified embodiment.

Figure 2:
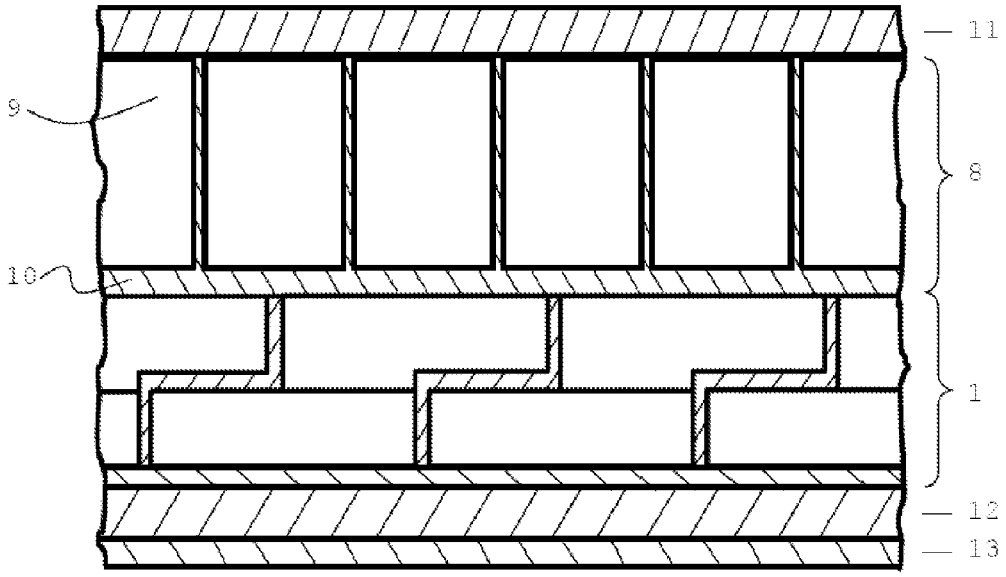
FIG. 2 shows a schematic diagram of a multi-layer construction.

FIG. 2 shows this type of multi-layer construction of the ballistic protection means.

A sacrificial layer 8 is placed in front of the shaped element composite 1 on the impact side, this layer being formed from a plurality of sacrificial elements 9 which, in the present exemplified embodiment, are essentially cube-shaped. Deflector edges are preferably integrally formed on the impact side (shown in FIG. 4).

The sacrificial elements 9 consist in the present exemplified embodiment of silicon carbide and are embedded in a splinter-slowing cast compound 10.

They serve in accordance with the invention to deflect and/or deform impacting bullets and to dissipate a substantial part of the bullet energy by destruction/splintering of the bullet and/or of the sacrificial elements 9 themselves. In so doing, upon impact by a bullet so much of its energy is preferably dissipated that the shaped element composite 1 is damaged as little as possible by the bullet.

The splinter-slowing cast compound 10 serves primarily to catch splinters, which are released in the sacrificial layer 8, from the bullet and/or from the sacrificial elements 9 and thus to prevent these splinters acting as secondary projectiles.

In particular, the multi-hit capability of the ballistic protection means is greatly improved by the sacrificial layer 8.

In order to catch released splinters of the bullet or of the sacrificial elements 9, in particular on the impact side, the sacrificial layer has a first splinter-catching layer 11 in front of it on the impact side, in the present exemplified embodiment this splinter-catching layer is produced from aramid.

For the event that a bullet passes through the sacrificial layer 8, reaches the shaped element composite 1 and damages one or a plurality of shaped elements 2, the shaped element composite 1 is provided with a second splinter-catching layer 12 on the protection side.

The second splinter-catching layer 12 serves in accordance with the invention to catch splinters from the shaped element composite 1 which are released by an impacting bullet and to effectively prevent them acting as secondary projectiles.

In order to improve in particular the wearing comfort of the ballistic protection means when used in a protective vest, a further advantageous embodiment of the invention makes provision that a functional layer 13 is disposed between the second splinter-catching layer 12 and a person to be protected (not shown).

The functional layer 13 is formed in a particularly advantageous manner in a heat-regulating and moisture-regulating manner and serves primarily to absorb and discharge moisture produced under the ballistic protection means by a person wearing it.

For the event that a ballistic protection means in accordance with the invention as described above is expanded by additional layers, the individual layers are connected to one another in a floating manner in each case.

By reason of the floating mutual connection of the individual layers, the flexibility and adaptability of the ballistic protection means is retained in a particularly advantageous manner even when multiple layers are used.

Figure 3A:
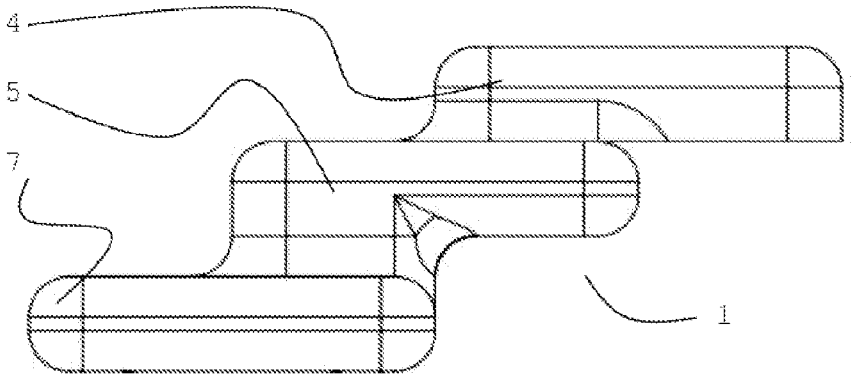
FIG. 3*a* shows a detailed view of a shaped element as seen from the side.
Figure 3B:
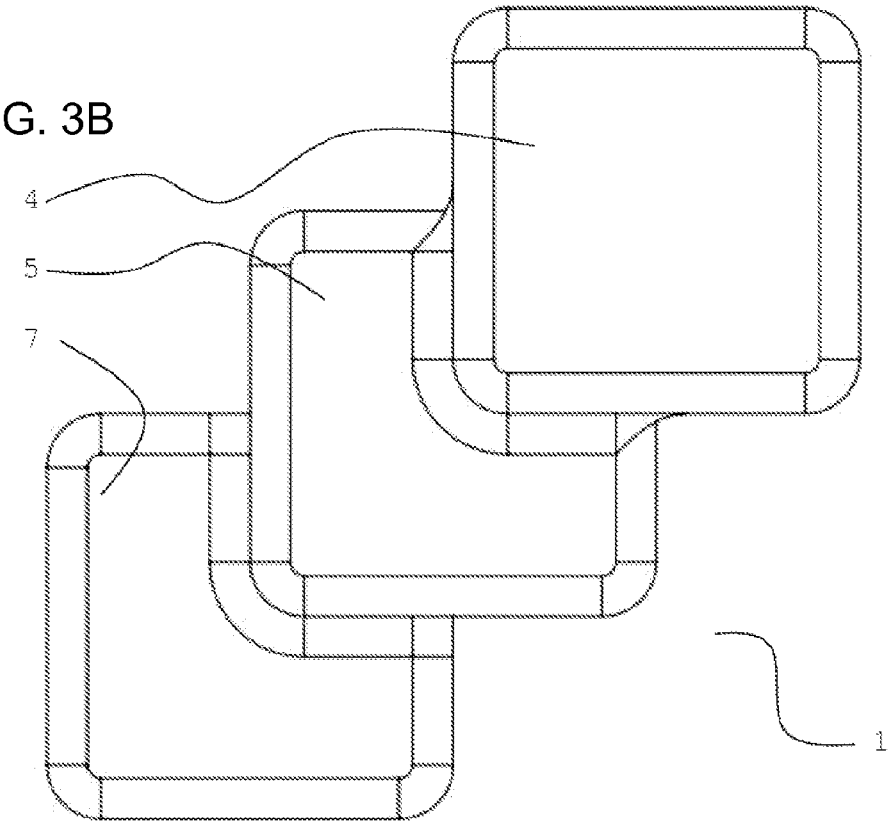
FIG. 3*b* shows a detailed view of a shaped element as seen in plan.

FIGS. 3*a* and 3*b* show detailed views of a shaped element 2 in a particular embodiment with three planes 4, 5 and 7.

The formation of a shaped element composite 1 in accordance with the invention from shaped elements 2 with three planes 4, 5 and 7 renders it possible in a particularly advantageous manner for the shaped element composite 1 to be free of either linear or point-shaped penetrations through which a bullet could pass unhindered through the shaped element composite 1.

Figure 4:
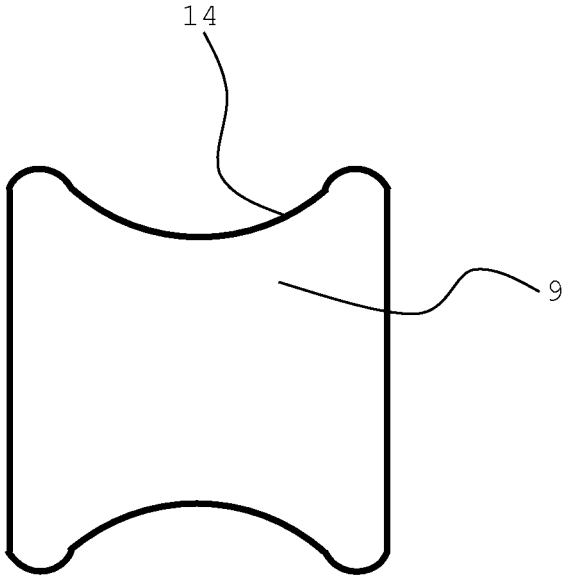
FIG. 4 shows a detailed view of a sacrificial element.

FIG. 4 shows an exemplified embodiment of a sacrificial element 9 with deflector edges 14.

REFERENCE NUMERALS USED

1 shaped element composite
2.1 first shaped element
2.2 second shaped element
3 support layer

4 first plane of the first shaped element
5 second plane of the second shaped element
6 filler
7 third plane of the shaped element
8 sacrificial layer
9 sacrificial elements
10 cast compound
11 first splinter-catching layer
12 second splinter-catching layer
13 functional layer
14 deflector edge

The invention claimed is:

1. A ballistic protection means, comprising:

a plurality of hard armouring shaped elements each defining at least two mutually offset planes;

said two mutually offset planes having material connection between one another for defining a continuous construction of said shaped elements;

at least two of said shaped elements being fixed in a positional relationship with respect to one another for defining a shaped element composite with a first plane of a first one of said at least two shaped elements overlapping, in sections, a second plane of a second one of said at least two shaped elements; and each of said at least two mutually offset planes of said shaped element composite defining a respective collective surface in total.

2. The ballistic protection means as claimed in claim 1, wherein said shaped elements are connected to a high-tensile support layer on a side facing an object to be protected.

3. The ballistic protection means as claimed in claim 1, wherein said shaped elements are disposed with an intermediate space formed therebetween, said intermediate space is provided with an elastic filler.

4. The ballistic protection means as claimed in claim 1, wherein said shaped elements are formed of ceramic material.

5. The ballistic protection means as claimed in claim 1, wherein said shaped elements are disposed offset in a longitudinal direction thereof in said shaped element composite.

6. The ballistic protection means as claimed in claim 1, wherein said shaped elements each have three mutually offset planes.

7. The ballistic protection means as claimed in claim 1, further comprising a sacrificial layer containing hard-armouring sacrificial elements which are embedded in a splinter-slowing cast compound, said sacrificial layer being disposed in front of said shaped element composite on a side facing away from an object to be protected.

8. The ballistic protection means as claimed in claim 7, further comprising a first splinter-catching layer disposed in front of said sacrificial layer.

9. The ballistic protection means as claimed in claim 1, wherein said shaped element composite is provided with a splinter catching layer on a side facing an object to be protected.

10. A ballistic protection device, comprising:

a plurality of hard armouring shaped elements each defining at least two mutually offset planes;

said two mutually offset planes being diagonally offset with respect to one another and having material connection between one another for defining a continuous construction of said shaped elements;

at least two of said shaped elements being fixed in a positional relationship with respect to one another for defining a shaped element composite with a first plane of a first one of said at least two shaped elements overlapping, in sections, a second plane of a second one of said at least two shaped elements.

11. The ballistic protection device as claimed in claim 10, wherein each of said at least two mutually offset planes of said shaped element composite define a respective collective surface in total.

12. The ballistic protection device as claimed in claim 10, wherein said mutually offset planes are squares and said material connection is provided between corners of said mutually offset planes.

13. The ballistic protection device as claimed in claim 10, wherein said mutually offset planes are parallel to one another.

* * * * *